US010766269B2

(12) United States Patent
Yada

(10) Patent No.: US 10,766,269 B2
(45) Date of Patent: Sep. 8, 2020

(54) PRINTER HAVING ACCOMMODATING PORTION FOR ACCOMMODATING PRINTING AGENT SUPPLIED FROM CARTRIDGE

(71) Applicant: BROTHER KOGYO KABUSHIKI KAISHA, Nagoya-shi, Aichi-ken (JP)

(72) Inventor: Yuki Yada, Kuwana (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/355,094

(22) Filed: Mar. 15, 2019

(65) Prior Publication Data

US 2019/0291452 A1 Sep. 26, 2019

(30) Foreign Application Priority Data

Mar. 24, 2018 (JP) ..... 2018-057319

(51) Int. Cl.
*B41J 2/175* (2006.01)
*B41J 29/38* (2006.01)

(52) U.S. Cl.
CPC ..... *B41J 2/17566* (2013.01); *B41J 2/1752* (2013.01); *B41J 2/17546* (2013.01); *B41J 29/38* (2013.01)

(58) Field of Classification Search
CPC .... B41J 2/17566; B41J 29/38; B41J 2/17546; B41J 2/1752; B41J 2/175; B41J 2/1753
See application file for complete search history.

(56) References Cited

U.S. PATENT DOCUMENTS 8,066,350 B2 * 11/2011 Yoshida ..... B41J 2/175 347/20

FOREIGN PATENT DOCUMENTS

JP 2005-241868 A 9/2005

OTHER PUBLICATIONS

IP.com search (Year: 2020).*

* cited by examiner

*Primary Examiner* — Lisa Solomon
(74) *Attorney, Agent, or Firm* — Merchant & Gould P.C.

(57) ABSTRACT

In a printer, an accommodating portion accommodates printing agent supplied from a first cartridge. A print execution device prints with the printing agent supplied from the accommodating portion. A processor acquires first information concerning a residual quantity of the printing agent remaining in the first cartridge. The processor acquires second information concerning a preparation of a second cartridge to be replaced with the first cartridge. If the residual quantity is below a reference quantity and if the second information is acquired, the processor allows the print execution device to perform printing under a cartridge removed state where the first cartridge is removed from the mount portion. If the residual quantity is larger than or equal to the reference quantity or if the second information is not acquired, the processor prohibits the print execution device from printing under the cartridge removed state.

13 Claims, 9 Drawing Sheets

FIRST STORAGE STATE S1

SECOND STORAGE STATE S2

FIG. 3 (A)

INFORMATION DATABASE IB

IB

| SERIAL NUMBER | MODEL NAME | IP ADDRESS | CARTRIDGE ID NUMBER | | RESIDUAL QUANTITY OF INK |
|---|---|---|---|---|---|
| | | | CURRENT CARTRIDGE | NEXT CARTRIDGE | |
| AAABBB | MDL_200 | IP_A | CN_11 | | 750 |

FIG. 3 (B)

MANAGEMENT DATABASE PD

PD

| | SERIAL NUMBER | MODEL NAME | IP ADDRESS | CARTRIDGE ID NUMBER | | ESTIMATED ORDER DATE | INK HISTORY INFORMATION | | | |
|---|---|---|---|---|---|---|---|---|---|---|
| | | | | CURRENT CARTRIDGE | NEXT CARTRIDGE (ORDERED) | | ACQUISITION DATE | RESIDUAL QUANTITY OF INK | ACQUISITION DATE | RESIDUAL QUANTITY OF INK |
| EN1 | AAABBB | MDL_200 | IP_A | CN_A1 | | 2018/3/20 | 2017/12/02 | 2100 | 2017/12/03 | 1900 |
| EN2 | CCCDDD | MDL_250 | IP_B | CN_B1 | CN_B2 | | 2017/12/02 | 250 | 2017/12/03 | 100 |

PRINTER HAVING ACCOMMODATING PORTION FOR ACCOMMODATING PRINTING AGENT SUPPLIED FROM CARTRIDGE

CROSS REFERENCE TO RELATED APPLICATION

This application claims priority from Japanese Patent Application No. 2018-057319 filed Mar. 24, 2018. The entire content of the priority application is incorporated herein by reference.

TECHNICAL FIELD

The present disclosure relates to a printer provided with a print execution device that executes printing operations using a printing agent supplied from an ink cartridge, and a system that includes this printer.

BACKGROUND

An image-forming apparatus known in the art on which is mounted a cartridge accommodating toner is provided with a reserve tank that temporarily stores toner supplied from the cartridge. The image-forming apparatus can execute printing operations even after the cartridge has been removed, in a case where the reserve tank still contains toner.

SUMMARY

Since the conventional image-forming apparatus can execute printing operations using residual toner in the reserve tank even when the cartridge has been removed, there is potential for the cartridge to be removed without careful consideration, for example. However, removing the cartridge without careful consideration could lead to missing cartridges or other problems.

In view of the foregoing it is an object of the present disclosure to provide a technique for suppressing a cartridge that accommodates a printing agent from being removed without careful consideration.

In order to attain the above and other objects, the disclosure provides a printer. The printer includes a mount portion, a print execution device, and a processor. The first cartridge storing printing agent is mountable on the mount portion. The accommodating portion is configured to accommodate the printing agent supplied from the first cartridge. The print execution device is configured to perform printing with the printing agent supplied from the accommodating portion. The processor is configured to perform: acquiring first information concerning a residual quantity of the printing agent remaining in the first cartridge; acquiring second information concerning a preparation of a second cartridge to be replaced with the first cartridge on the mount portion; if the residual quantity of the printing agent remaining in the first cartridge is below a reference quantity and if the second information is acquired, allowing the print execution device to perform printing under a cartridge removed state where the first cartridge is removed from the mount portion; and if the residual quantity of the printing agent remaining in the first cartridge is larger than or equal to the reference quantity or if the second information is not acquired, prohibiting the print execution device from printing under the cartridge removed state.

According to another aspect, the disclosure provides a system. The system includes a printer and an apparatus communicable with the printer. The printer includes a mount portion, a print execution device, and a first processor. The first cartridge storing printing agent is mountable on the mount portion. The accommodating portion is configured to accommodate the printing agent supplied from the first cartridge. The print execution device is configured to perform printing with the printing agent supplied from the accommodating portion. The first processor is configured to perform: acquiring first information concerning a residual quantity of the printing agent remaining in the first cartridge; acquiring second information concerning a preparation of a second cartridge to be replaced with the first cartridge on the mount portion; if the residual quantity of the printing agent remaining in the first cartridge is below a reference quantity and if the second information is acquired, allowing the print execution device to perform printing under a cartridge removed state where the first cartridge is removed from the mount portion; and if the residual quantity of the printing agent remaining in the first cartridge is larger than or equal to the reference quantity or if the second information is not acquired, prohibiting the print execution device from printing under the cartridge removed state. The apparatus includes a second processor configured to perform: a preparation process for preparing the second cartridge; transmitting the second information to the printer in a case where the preparation process is performed.

According to still another aspect, the disclosure provides a non-transitory computer readable storage medium storing a set of program instructions for a printer having: a mount portion on which a first cartridge storing printing agent is mountable; an accommodating portion configured to accommodate the printing agent supplied from the first cartridge; a print execution device configured to perform printing with the printing agent supplied from the accommodating portion; and a processor. The set of program instructions includes: acquiring first information concerning a residual quantity of the printing agent remaining in the first cartridge; acquiring second information concerning a preparation of a second cartridge to be replaced with the first cartridge on the mount portion; if the residual quantity of the printing agent remaining in the first cartridge is below a reference quantity and if the second information is acquired, allowing the print execution device to perform printing under a cartridge removed state where the first cartridge is removed from the mount portion; and if the residual quantity of the printing agent remaining in the first cartridge is larger than or equal to the reference quantity or if the second information is not acquired, prohibiting the print execution device from printing under the cartridge removed state.

BRIEF DESCRIPTION OF THE DRAWINGS

The particular features and advantages of the disclosure as well as other objects will become apparent from the following description taken in connection with the accompanying drawings, in which:

FIG. 3(A) is a table illustrating an example of an information database according to the embodiment;

FIG. 3(B) is a table illustrating an example of a management database according to the embodiment;

DETAILED DESCRIPTION

A. Embodiment

A-1. Structure of a System 1000

Figure 1:
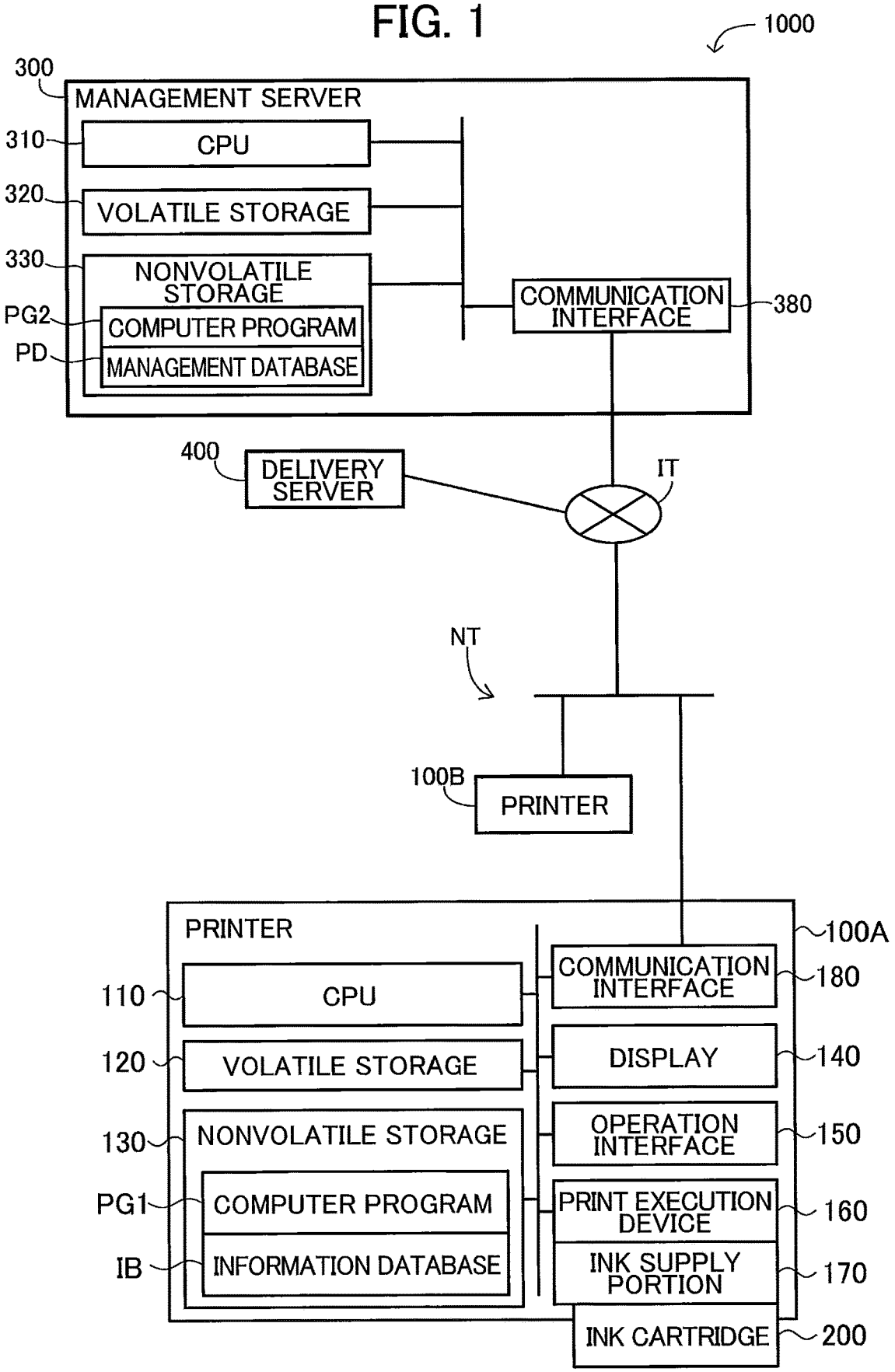
FIG. 1 is a block diagram illustrating a structure of a system according to an embodiment.

FIG. 1 is a block diagram showing the structure of a system 1000. The system 1000 is provided with printers 100A and 100B, a management server 300, and a delivery server 400. The printers 100A and 100B are connected to a local area network NT. The management server 300, the delivery server 400, and the local area network NT are connected to an internet IT. The printers 100A and 100B and the management server 300 can communicate with each other via the local area network NT and the internet IT. The management server 300 and the delivery server 400 can communicate with each other over the internet IT.

Since the printers 100A and 100B have the same structure, the following description will focus on the structure of the printer 100A. The printer 100A includes a CPU 110 constituting the controller of the printer 100A; a volatile storage 120, such as DRAM; a nonvolatile storage 130, such as a hard disk drive or a flash memory; a display 140, such as a liquid crystal display that displays images; an operation interface 150, such as a touchscreen and buttons designed to acquire operations performed by the user; a print execution device 160; an ink supply portion 170; and a communication interface 180.

The communication interface 180 functions to connect the printer 100A to an external apparatus such as the management server 300 via the local area network NT. Specifically, the communication interface 180 is a wired interface conforming to Ethernet (registered trademark), or a wireless interface conforming to the Wi-Fi technology (based on the IEEE (Institute of Electrical and Electronics Engineers, Inc.) 802.11 standard or a standard based on this standard, such as one of the versions 802.11a, 11b, 11g, and 11n).

The CPU 110 is a processor that performs data processing. The volatile storage 120 provides a buffer region that temporarily stores various intermediate data generated when the CPU 110 performs processes. The nonvolatile storage 130 stores a computer program PG1 for controlling the printer, and an information database IB described later.

In the embodiment, the computer program PG1 may be pre-stored in the nonvolatile storage 130 when the printer 100A is manufactured. Alternatively, the computer program PG1 may be made available through download from a server connected to the printer 100A over the internet IT, or may be provided in a recorded format, such as on a CD-ROM.

By executing the computer program PG1, the CPU 110 executes a printing process for controlling the print execution device 160 to print images. Also by executing the computer program PG1, the CPU 110 executes a cartridge management process described later in cooperation with the management server 300 and the delivery server 400. In addition, by executing the computer program PG1 the CPU 110 executes a print management process A for controlling whether printing is allowed in a state where an ink cartridge 200 is removed, and a print management process B for controlling whether printing is allowed in a state where an ink cartridge 200 is mounted. The cartridge management process will be described later for both print management processes A and B.

Figure 2:
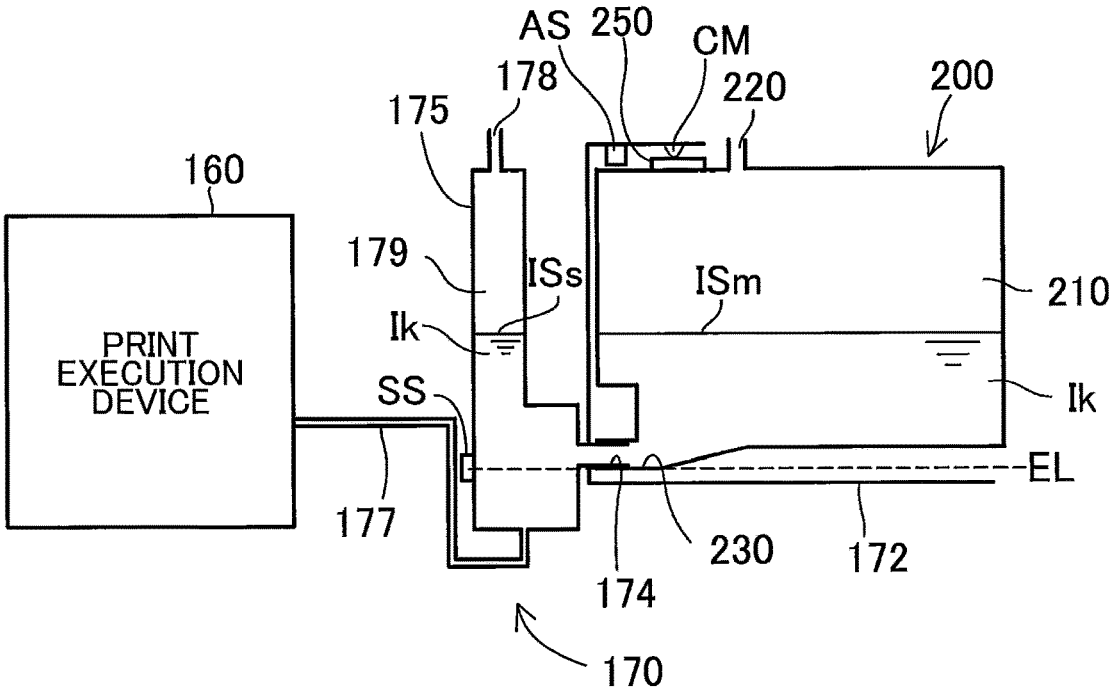
FIG. 2(A) is a schematic diagram showing structures of a print execution device and an ink supply portion when a storage state of ink is a first storage state.
FIG. 2(B) is a schematic diagram showing structures of the print execution device and the ink supply portion when the storage state is a second storage state.
Figure 2:
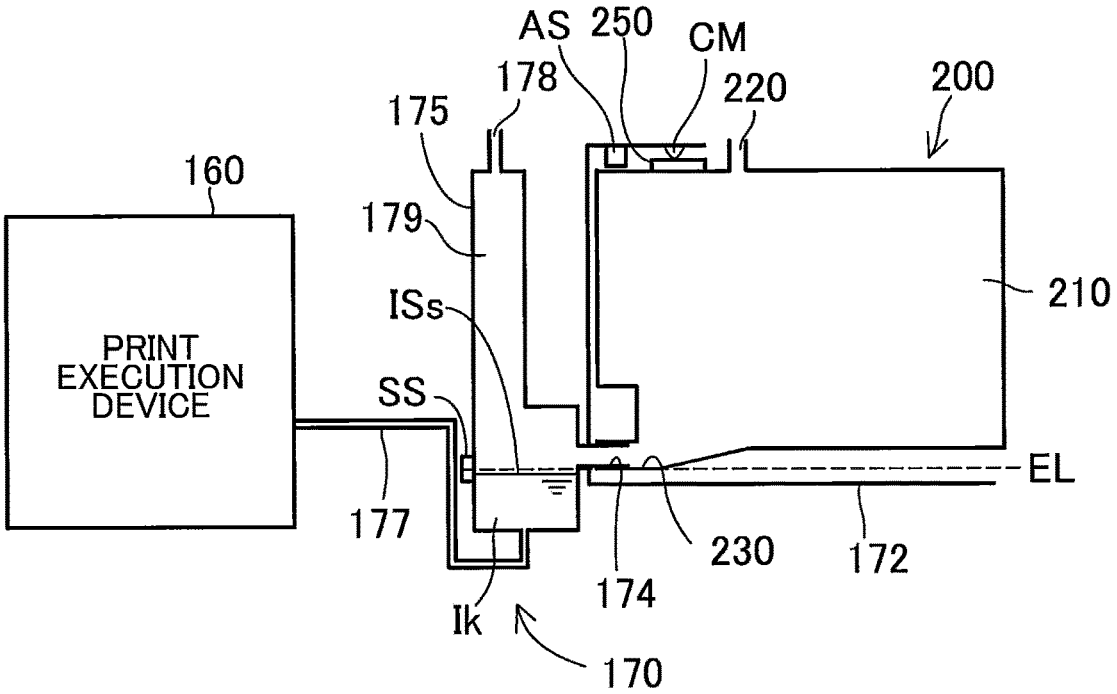

The print execution device 160 executes printing operations under control of the CPU 110. The ink supply portion 170 supplies an ink Ik as the printing agent to the print execution device 160. FIGS. 2(A) and 2(B) are schematic diagrams showing the structures of the print execution device 160 and the ink supply portion 170.

The print execution device 160 is an inkjet-type printing mechanism that prints images on paper constituting the printing medium using ink supplied from an ink cartridge 200 as the printing agent. Specifically, the print execution device 160 forms images on paper by ejecting ink onto the paper from nozzles formed in a print head (not shown) to form dots on the paper. In the embodiment, the print execution device 160 is a monochromatic printing mechanism using a single color of ink (black (K), for example).

As shown in FIGS. 2(A) and 2(B), the ink supply portion 170 is provided with a mount portion 172 in which the ink cartridge 200 is mounted, an ink supply opening 174, an intermediate tank 175, and an ink channel section 177.

Formed in the ink cartridge 200 are a main storage chamber 210 for accommodating ink Ik, an air hole 220, and an ink outlet 230. The air hole 220 is an opening providing communication between the main storage chamber 210 and the external air. The ink outlet 230 is an opening through which the ink Ik is supplied from the main storage chamber 210 to the ink supply portion 170. The ink outlet 230 is provided near the bottom of the main storage chamber 210 so as to be capable of supplying all of the ink Ik in the main storage chamber 210 into the ink supply portion 170.

A chip 250 is mounted on the outer surface of the ink cartridge 200. The chip 250 has a memory for storing various information about the ink cartridge 200. The information stored in the memory of the chip 250 in the embodiment includes information specifying an initial ink volume constituting the quantity of ink Ik accommodated in a new ink cartridge 200, and identification information (a serial number) identifying the ink cartridge 200.

The mount portion 172 is a holder, for example, in which the ink cartridge 200 is detachably mountable. The ink supply opening 174 is in connection with the ink outlet 230 of the ink cartridge 200 mounted in the mount portion 172, and the intermediate tank 175 communicates with the main storage chamber 210 via the ink supply opening 174 and the ink outlet 230. The ink Ik in the main storage chamber 210 is supplied into the ink supply portion 170 through the ink supply opening 174. The mount portion 172 has a contact CM that contacts an electrode on the chip 250 of the ink cartridge 200 when the ink cartridge 200 is mounted in the mount portion 172. The printer 100A (the CPU 110) can read information stored in the memory of the chip 250 or write information to the memory through the contact CM.

A mounting sensor AS is provided in the mount portion 172 for detecting whether the ink cartridge 200 is mounted in the mount portion 172. The mounting sensor AS is provided with a light-emitting portion for emitting light, and a light-receiving portion for receiving the light, for example. When the ink cartridge 200 is mounted in the mount portion 172, a rib (not shown) formed on the housing of the ink cartridge 200 is disposed in a position at which the rib blocks light traveling from the light-emitting portion toward the light-receiving portion. The light-receiving portion of the mounting sensor AS outputs an electric signal to the CPU 110 indicating whether light has been received. The electric signal specifying that light is received is a signal indicating that the ink cartridge 200 is not mounted (hereinafter called an unmounted signal), while the electric signal specifying that light is not received is a signal indicating that the ink cartridge 200 is mounted (hereinafter called a mounted signal). Various other configurations may be applied to the mounting sensor AS, such as a configuration for detecting that the contact CM is in contact with the electrode of the chip 250, for example.

An auxiliary storage chamber 179 for accommodating the ink Ik and an air hole 178 are formed in the intermediate tank 175. The air hole 178 is an opening providing communication between the auxiliary storage chamber 179 and the external air. The auxiliary storage chamber 179 communicates with the main storage chamber 210 mounted in the mount portion 172 via the ink supply opening 174, and stores ink Ik supplied from the ink cartridge 200 through the ink supply opening 174.

Hereinafter, "upstream" and "downstream" are used with respect to an ink supply direction from the ink cartridge 200 to the print execution device 160. The upstream end of the ink channel section 177 is connected to the intermediate tank 175 near the bottom surface of the auxiliary storage chamber 179 and is in communication with the auxiliary storage chamber 179. The downstream end of the ink channel section 177 is connected to the print head (not shown) of the print execution device 160. With this configuration, ink Ik in the auxiliary storage chamber 179 is supplied to the print execution device 160 through the ink channel section 177.

As is clear from the above description, the intermediate tank 175 is disposed along the path of ink Ik flowing from the ink cartridge 200 mounted in the mount portion 172 to the print execution device 160.

This type of ink supply method that provides an intermediate tank along the flow path of the ink Ik leading from the ink cartridge to the print execution device 160, as in the ink supply portion 170 of the printer 100A, will be called a double-chamber supply method. FIG. 2(A) depicts the ink supply portion 170 when a state of stored ink Ik (hereinafter, referred to the storage state) is a first storage state S1, while FIG. 2(B) depicts the ink supply portion 170 when the storage state is a second storage state S2. In the first storage state S1, ink Ik remains in the ink cartridge 200 (in the main storage chamber 210) and in the intermediate tank 175 (in the auxiliary storage chamber 179). In the second storage state S2, ink Ik remains in the intermediate tank 175 (the auxiliary storage chamber 179), but no longer remains in the ink cartridge 200 (the main storage chamber 210).

The main storage chamber 210 in the ink cartridge 200 communicates with the atmosphere through the air hole 220, while the auxiliary storage chamber 179 in the intermediate tank 175 communicates with the atmosphere through the air hole 178. The auxiliary storage chamber 179 of the intermediate tank 175 includes a section positioned lower (below in FIG. 2) than the lower end (the bottom) of the main storage chamber 210 formed in the ink cartridge 200, and a section positioned higher than the bottom of the main storage chamber 210. Thus, when a new ink cartridge 200 is mounted in the mount portion 172, some of the ink Ik in the ink cartridge 200 transfers from the main storage chamber 210 into the auxiliary storage chamber 179 through the ink supply opening 174. Consequently, the level ISm of ink Ik in the main storage chamber 210 and the level ISs of ink Ik in the auxiliary storage chamber 179 are adjusted to the same height (see FIG. 2(A)).

As ink Ik is consumed through printing by the print execution device 160, the levels ISm and ISs drop while remaining at the same level to each other. Once the levels ISm and ISs reach a vertical position EL corresponding to the bottom of the main storage chamber 210 (hereinafter called an "empty level EL"), ink Ik no longer remains in the main storage chamber 210. Hence, the state of the ink Ik shifts from the first storage state S1 in FIG. 2(A) to the second storage state S2 in FIG. 2(B). Here, the state in which ink Ik no longer remains in the main storage chamber 210 of the ink cartridge 200 signifies that ink Ik no longer transfers from the main storage chamber 210 into the auxiliary storage chamber 179 and includes the state in which some ink Ik remains deposited on the inner walls of the main storage chamber 210.

The print execution device 160 can continue to print even after the storage state of the ink Ik has shifted to the second storage state S2, in a case where ink Ik remains in the auxiliary storage chamber 179. If the ink cartridge 200 is replaced with a new ink cartridge after the storage state has shifted to the second storage state S2, ink Ik will not be wasted since no ink Ik remains in the old ink cartridge 200 being replaced. Hence, the double-chamber supply method is advantageous in that the ink cartridge 200 can be replaced while printing is still possible, without wasting any ink Ik.

In the double-chamber supply method, a liquid level sensor SS is provided in the intermediate tank 175 for detecting whether the level ISs of ink Ik in the auxiliary storage chamber 179 has reached the empty level EL. With this arrangement, the CPU 110 can detect whether ink Ik remains in the ink cartridge 200. The liquid level sensor SS may be configured with a float having a smaller specific gravity than that of the ink Ik. With this configuration, the position of the float moves downward after the level ISs reaches the empty level EL, making it possible to detect when the level ISs has reached the empty level EL by detecting movement of the float. The liquid level sensor SS outputs a signal based on the residual quantity of ink Ik in the ink cartridge 200. For example, the liquid level sensor SS outputs an OFF signal when the level ISs of the ink Ik is at or above the empty level EL and outputs an ON signal when the level ISs of the ink Ik below the empty level EL. In other words, the liquid level sensor SS detects whether the storage state of ink is the first storage state S1 or the second storage state S2. Other methods known in the art may be employed as the liquid level sensor SS, such as a method of measuring the electrical resistance of the ink Ik or a method of using a prism to vary the diffraction of light. The ink cartridge 200 need not be provided with the liquid level sensor SS when using the double-chamber supply method in the embodiment. Accordingly, the double-chamber supply method is also advantageous in that the structure of the ink cartridge 200 can be simplified.

The ink volume corresponding to the boundary between the first storage state S1 and the second storage state S2 will be called a boundary volume BV. The boundary volume BV in the embodiment may be considered the volume of ink in the auxiliary storage chamber 179 when the level ISs in the auxiliary storage chamber 179 has dropped to the empty level EL. The boundary volume BV may also be considered the maximum ink volume in the second storage state S2. The boundary volume BV is a value dependent on the structure and size of the intermediate tank 175 and is specific to each model of printer.

FIGS. 3(A) and 3(B) show examples of the information database D3 and the management database PD (described later). The information database D3 in FIG. 3(A) stores printer information related to the printer 100A. The printer information includes information specifying the serial number and model name of the printer 100A and the IP address assigned to the printer 100A, for example. The printer information also includes an identification number for the ink cartridge 200 currently being used (hereinafter called the "current cartridge ID number"), and the identification number for an ink cartridge 200 that has been ordered and is expected to be used next (hereinafter called the "next cartridge ID number"). The printer information also includes information specifying the residual quantity of ink Ik. The residual quantity of ink Ik is the sum of the ink Ik remaining in the ink cartridge 200 having the current cartridge ID number and the ink Ik remaining in the intermediate tank 175. The residual quantity of ink Ik is calculated by subtracting from the initial ink volume the quantity of ink Ik consumed between the time the ink cartridge 200 was last replaced and the present time for the ink cartridge 200. The printer 100A (the CPU 110) updates the residual quantity of ink Ik stored in the information database IB each time a printing operation is executed, for example. The information database IB includes other information, such as information about the printing history. However, the information database IB shown in the example of FIG. 3(A) shows only information used in the description of the embodiment.

The management server 300 is a computer and is used to manage printers targeted for management, such as the printers 100A and 100B. As shown in FIG. 1, the management server 300 is provided with a CPU 310 serving as the controller of the management server 300; a volatile storage 320, such as DRAM; a nonvolatile storage 330, such as a hard disk drive or a flash memory; and a communication interface 380.

The communication interface 380 functions to connect the management server 300 to external devices (the printers 100A and 100B and the delivery server 400, for example) via the internet IT. As with the communication interface 180, the communication interface 380 is a wired interface conforming to Ethernet (registered trademark), or a wireless interface conforming to Wi-Fi technology or a standard based on this technology.

The CPU 310 is a processor that performs data processes. The volatile storage 320 provides a buffer region for temporarily storing various intermediate data generated when the CPU 310 performs processes. The nonvolatile storage 330 stores a computer program PG2, and a management database PD.

The computer program PG2 is an application program provided in a downloadable format from a vendor server. Here, the vendor server is a server provided by the company that manages the system 1000 or the vendor that manufactures the printers 100A and 100B. Alternatively, the computer program PG2 may be provided in a recorded format, such as on a CD-ROM, or may be pre-stored in the nonvolatile storage 330 when the management server 300 is manufactured.

By executing the computer program PG2, the management server 300 (the CPU 310) can execute the cartridge management process described later in cooperation with the printers 100A and 100B and the delivery server 400.

The management server 300 collects printer information and records the collected printer information in the management database PD. FIG. 3(B) shows an example of the management database PD according to the embodiment. As shown in FIG. 3(B), the management database PD includes entries EN1 and EN2 corresponding to the printers 100A and 100B under management.

The entry EN1 that corresponds to the printer 100A includes a plurality of printer information items for the printer 100A, and specifically the serial number, the model name, the IP address, and ink-related information for the ink Ik. The ink-related information includes the current cartridge ID number and the next cartridge ID number described above, an estimated order date, and ink history information.

The estimated order date is the date on which an order process will likely be executed to order the next ink cartridge 200. The ink history information includes information specifying residual quantities of ink Ik acquired from the printer 100A and recorded in association with the dates acquired (acquisition dates). The ink history information includes information specifying a plurality of residual quantities of ink Ik, and information specifying the plurality of corresponding acquisition dates.

The delivery server 400 is operated by the distributor of the ink cartridges 200. In the cartridge management process described later, the delivery server 400 receives order information for ink cartridges 200 and transmits ID numbers for ordered ink cartridges 200.

A-2. Operations of the System 1000

A-2-1. Cartridge Management Process

The cartridge management process is concerned with the ordering and delivery of cartridges based on residual quantities of ink Ik in the printers 100A and 100B. The printers 100A and 100B, the management server 300, and the delivery server 400 execute the cartridge management process in concert.

First, the process performed on the management server 300 (the CPU 310) will be described. The management server 300 receives residual ink information periodically transmitted from the printers 100A and 100B under management. For example, each of the printers 100A and 100B transmits residual ink information one time per day at a predetermined time. Alternatively, the printers 100A and 100B may transmit residual ink information each time a fixed quantity of printing has been executed. The residual ink information includes the serial number of the printer 100A, the current cartridge ID number, and the current residual ink quantity described above that are recorded in the information database IB (see FIG. 3(A)), for example.

Figure 4:
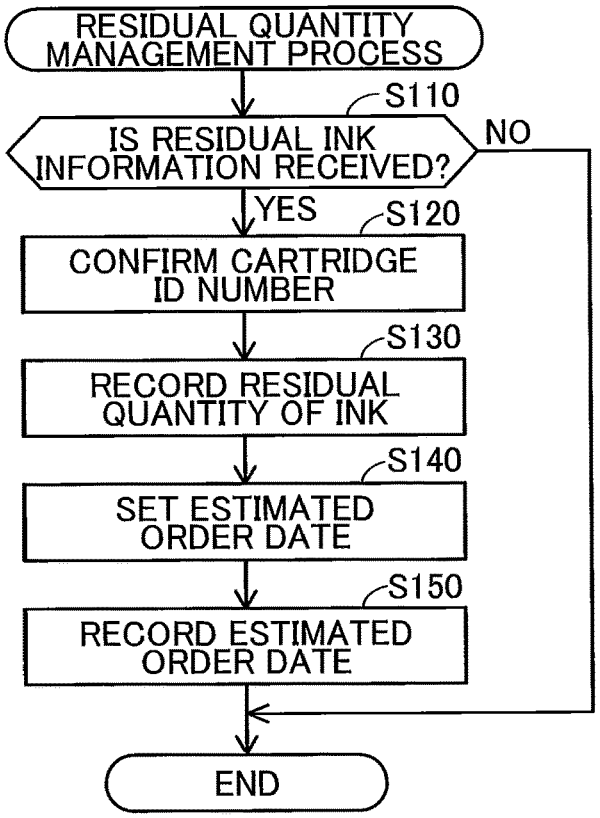
FIG. 4 is a flowchart illustrating a residual quantity management process performed by a management server according to the embodiment.

The management server 300 executes a residual quantity management process to set an estimated order date for ordering an ink cartridge 200 for each printer under management based on the residual ink information for the respective printer. FIG. 4 is a flowchart illustrating steps in the residual quantity management process. The management server 300 continuously repeats the residual quantity management process (every few seconds, for example) as long as the management server 300 is running, for example.

In S110 at the beginning of the process in FIG. 4, the management server 300 (the CPU 310) determines whether residual ink information was received. The CPU 310 executes the subsequent steps S120-S150 when residual ink information was received (S110: YES) and ends the residual quantity management process when residual ink information was not received (S110: NO). In this way, the process from S120 to S150 is executed each time residual ink information is received.

In S120 the CPU 310 confirms the cartridge ID number included in the residual ink information. For example, the CPU 310 references the management database PD based on the serial number included in the residual ink information and the source IP address of the residual ink information to identify the source printer of the residual ink information (or, to identify an entry (EN1 or EN2)). In the following description, it will be assumed that the source printer is the printer 100A. The CPU 310 confirms whether the current or next cartridge ID number of the printer 100A recorded in the management database PD matches the cartridge ID number included in the residual ink information. Although not illustrated in the flowchart, the CPU 310 may execute a prescribed error process and subsequently end the residual quantity management process when neither the current nor next cartridge ID number for the printer 100A matches the cartridge ID number included in the residual ink information, for example. In the error process, the CPU 310 may transmit an error notification to the printer 100A, for example. The CPU 310 continues to S130 when the current cartridge ID number matches the cartridge ID number included in the residual ink information. When the next cartridge ID number matches the cartridge ID number included in the residual ink information, it may be assumed that the ink cartridge 200 was replaced. In this case, the CPU 310 records the next cartridge ID number in the management database PD as the new current cartridge ID number with the field for recording the next cartridge ID number left as a null field, and advances to S130.

In S130 the CPU 310 records the residual quantity of ink Ik specified in the residual ink information in the ink history information of the entry EN1 for the printer 100A in association with the acquisition date for this residual quantity. The acquisition date is the date on which the residual ink information was received.

Figure 5:
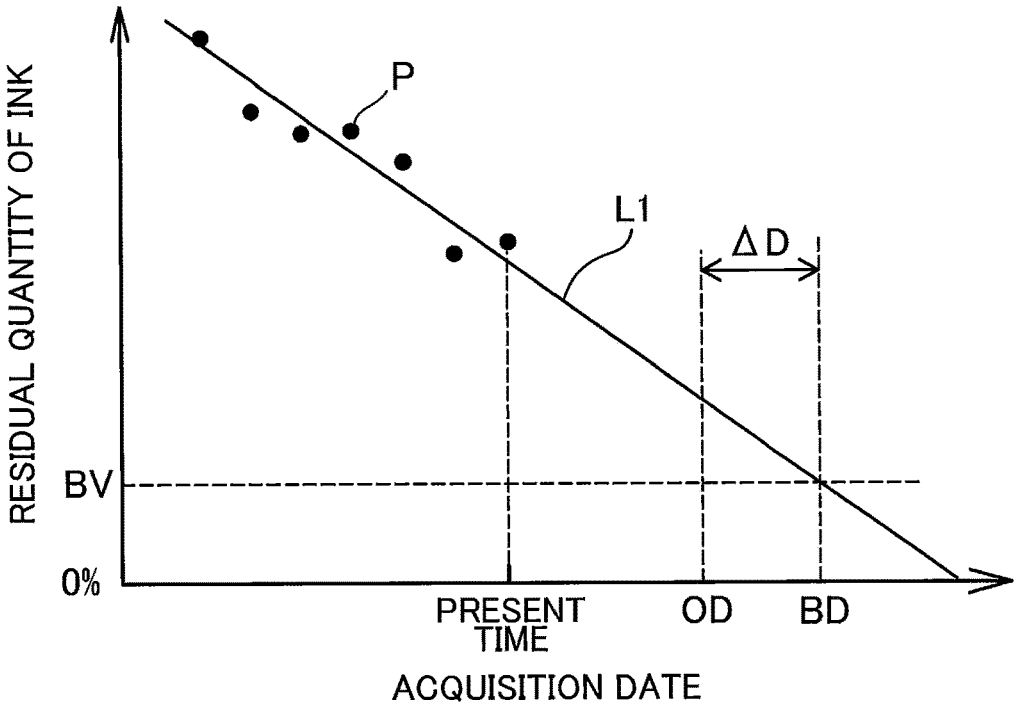
FIG. 5 is a graph showing a relation between a residual quantity of ink and acquisition date.

In S140 the CPU 310 sets the estimated order date. FIG. 5 illustrates a sample method of setting the estimated order date. In the graph of FIG. 5, the vertical axis represents the residual quantity of ink, and the horizontal axis represents the acquisition date for the residual quantity of ink Ik. A plurality of black dots P in the graph indicates a plurality of residual quantities of ink Ik acquired from the printer 100A to date. The CPU 310 sets an approximation line L1 indicating the transition of residual quantities of ink Ik over time based on the residual quantities of ink Ik acquired to date. The CPU 310 sets an expected cartridge replacement date BD to the date at which the residual quantity of ink Ik will reach the boundary volume BV described above based on the approximation line L1. The date on which the residual quantity of ink Ik reaches the boundary volume BV may be considered the date on which the storage state of ink Ik shifts from the first storage state S1 in FIG. 2(A) to the second storage state S2 in FIG. 2(B). The CPU 310 sets the estimated order date OD to the date prior to the expected cartridge replacement date BD by a prescribed number of days AD. The prescribed number of days AD is set based on a reference number of days required for a new ink cartridge 200 to be delivered to the user of the printer 100A after the ink cartridge 200 has been ordered.

In S150 the CPU 310 records or overwrites the estimated order date in the management database PD and subsequently ends the residual quantity management process. As described above, the estimated order date can be updated each time residual ink information is acquired.

Figure 6:
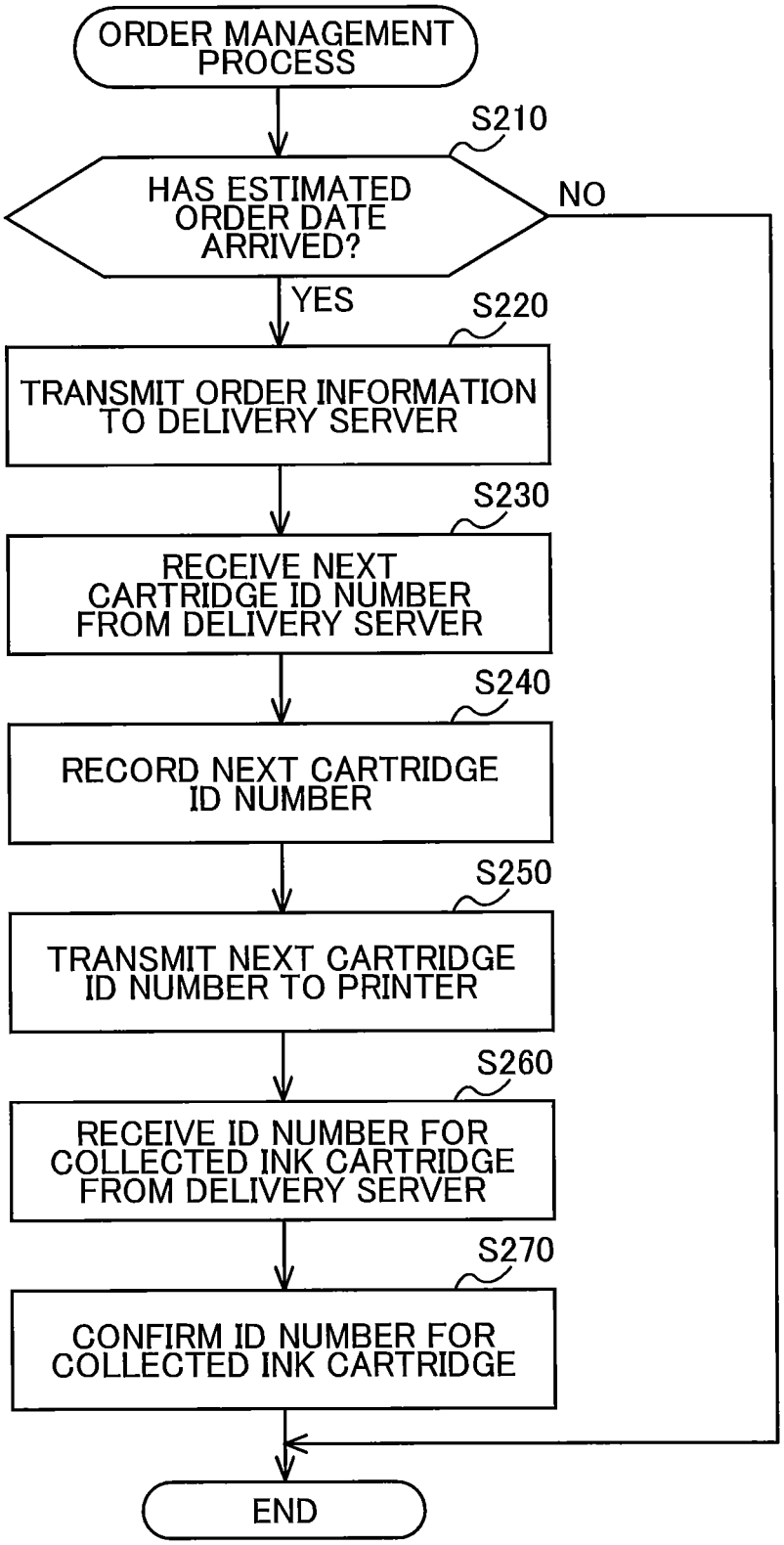
FIG. 6 is a flowchart illustrating an order management process performed by the management server according to the embodiment.

The CPU 310 also executes an order management process concerned with ordering ink cartridges 200. FIG. 6 is a flowchart illustrating steps in the order management process. The CPU 310 repeatedly executes the order management process (every few seconds, for example) as long as the CPU 310 is running, for example.

In S210 at the beginning of the process in FIG. 6, the CPU 310 determines for each printer under the management whether the estimated order date OD recorded in the printer has arrived. If the estimated order date OD has arrived (S210: YES), the CPU 310 executes the process from S220 to S260. If no estimated order date OD has arrived (S210: NO), the CPU 310 ends the order management process. In this way, the process of S220-S260 is executed each time an estimated order date OD has arrived. In the following description, it will be assumed that the estimated order date OD for the printer 100A has arrived.

In S220 the CPU 310 transmits order information to the delivery server 400 for ordering an ink cartridge 200 for a printer whose estimated order date has arrived (the printer 100A in this example). The order information includes a code specifying the type of the ink cartridge 200 being ordered, and information specifying the delivery destination for the ink cartridge 200, for example. Upon receiving the order information, the delivery server 400 executes a delivery process. Specifically, the delivery server 400 sets an ID number for the ink cartridge 200 to be shipped, and transmits this ID number to the management server 300. The ID number for the ink cartridge 200 being shipped may be selected from an inventory list for ink cartridges 200 managed by the delivery server 400, for example. The delivery server 400 transmits delivery instructions including the ID number and delivery destination for the ink cartridge 200 to an email address for a delivery manager, for example. In response to these instructions, the delivery manager delivers the ink cartridge 200 having the specified ID number to the delivery destination, i.e., the user of the printer 100A in this example. As another example, the delivery server 400 may receive an ID number that the packaging manager obtains by reading a bar code associated with the ink cartridge 200 when packaging the ink cartridge 200 to be shipped, and may transmit this ID number to the management server 300.

In S230 the CPU 310 receives the ID number for the ink cartridge 200 being shipped from the delivery server 400 as the next cartridge ID number described above. In S240 the CPU 310 records the next cartridge ID number received in S230 in the management database PD (the entry EN1).

In S250 the CPU 310 transmits this next cartridge ID number to the printer 100A. Note that after the new ink cartridge 200 reaches the user of the printer 100A and the user replaces the used ink cartridge 200 with the new ink cartridge 200, the delivery manager may collect the used ink cartridge 200. In this case, the driver of the delivery vehicle records the ID number for the collected ink cartridge 200 in a collection list managed by the delivery server 400. The delivery server 400 transmits the ID number of the collected ink cartridge 200 to the CPU 310. In S260 the CPU 310 receives the ID number for the collected ink cartridge 200 from the delivery server 400. Here, a considerable amount of time (several days to several weeks, for example) may elapse between execution of steps S250 and S260. In S270 the CPU 310 determines whether the ID number for the collected ink cartridge 200 matches the ID number for the ink cartridge 200 in the printer 100A at the time the order process in S220 was executed, and subsequently ends the order management process. If step S260 is not executed for more than a prescribed period after execution of step S260, the CPU 310 may determine that the used ink cartridge 200 was not collected.

Figure 7:
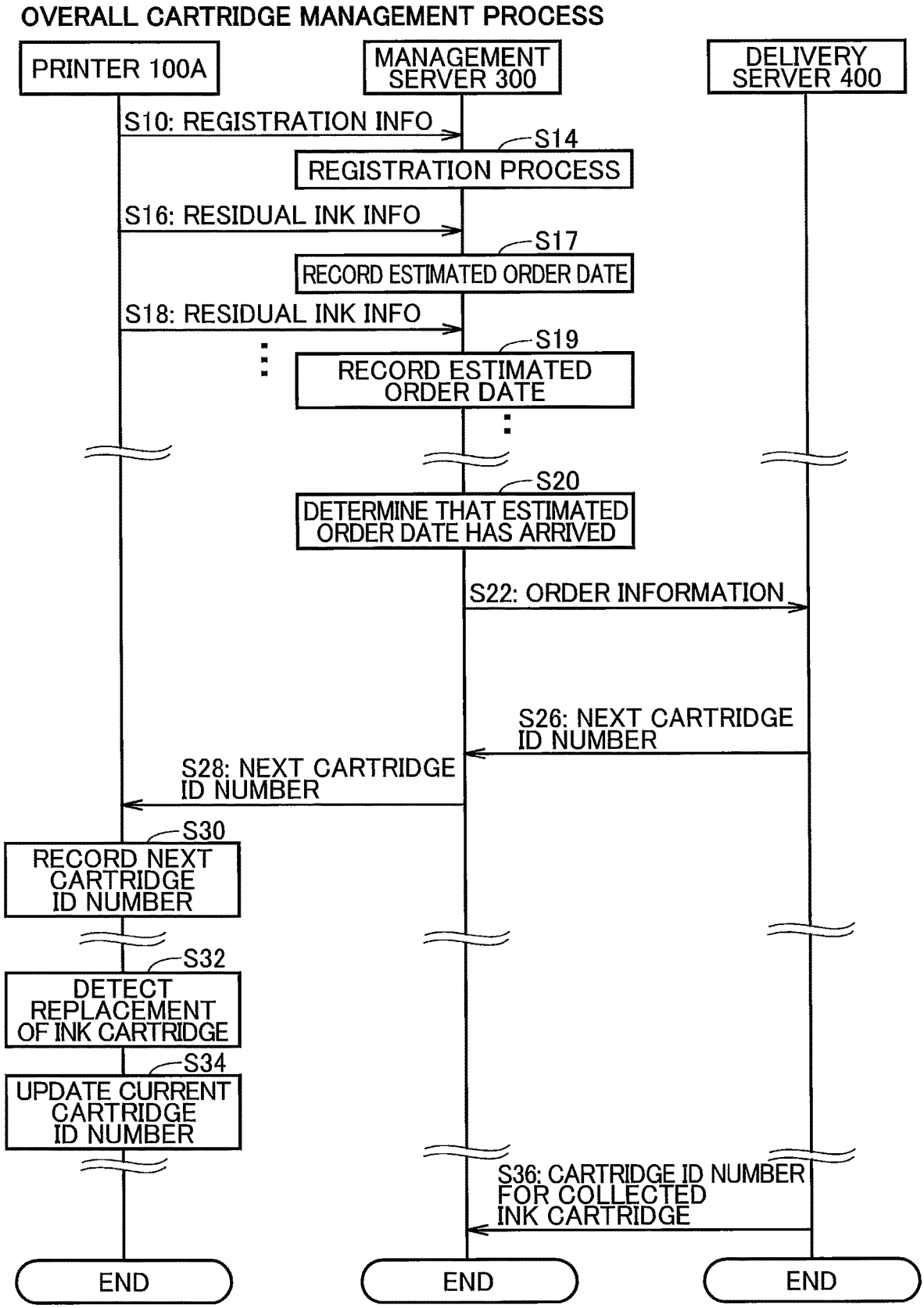
FIG. 7 is a sequence diagram illustrating an overall cartridge management process according to the embodiment.

Next, the overall cartridge management process including the processes described above will be described with reference to the sequence chart in FIG. 7. The sequence chart in FIG. 7 illustrates the sequence of processes executed by the printer 100A, the management server 300, and the delivery server 400 in the cartridge management process.

In S10 the printer 100A (the CPU 110) transmits registration information to the management server 300. The registration information may include such items obtained from the printer information recorded in the information database IB described above as the serial number, the model name, and the IP address.

Upon receiving this registration information, in S14 the management server 300 executes a registration process for registering the printer target for management. Specifically, the CPU 310 creates a new entry in the management database PD and records the registration information received from the printer 100A (the serial number, the model name, and the IP address) in this new entry. As a rule, steps S10 and S14 are executed at the beginning of the cartridge management process for each printer under management.

In S16 and S18, the printer 100A registered as a printer under management periodically transmits residual ink information to the management server 300 as described above. Since the management server 300 executes the residual quantity management process of FIG. 4 each time the management server 300 receives residual ink information, in S17 and S19 the management server 300 records an estimated order date (S150 of FIG. 4).

When the estimated order date subsequently arrives, in S20 the management server 300 determines that the estimated order date has arrived (S210: YES of FIG. 6). In S22 the management server 300 transmits order information to the delivery server 400 (S220 of FIG. 6). Upon receiving this order information, in S26 the delivery server 400 transmits the next cartridge ID number (the ID number of the ink cartridge 200 shipped or to be shipped) to the management server 300. Upon receiving the next cartridge ID number (S230 of FIG. 6), in S28 the management server 300 transmits this next cartridge ID number to the printer 100A (S250 of FIG. 6).

When the printer 100A receives the next cartridge ID number from the management server 300, in S30 the printer 100A records this next cartridge ID number in the information database IB (FIG. 3(A)). Although an ID number is not recorded in the field for the next cartridge ID number in the example of FIG. 3(A), in this step the next cartridge ID number will be recorded in this field.

Once the next ink cartridge 200 to be used reaches the user of the printer 100A, the user replaces the old ink cartridge 200 in the printer 100A with the new ink cartridge 200. After the user replaces the ink cartridge 200, in S32 the printer 100A detects that the ink cartridge 200 was replaced and in S34 updates the current cartridge ID number recorded in the information database IB. Specifically, the printer 100A records the next cartridge ID number in the information database IB as the new current cartridge ID number. In other words, the printer 100A sets the field of the current cartridge ID number to a number which is presently stored in the field of the next cartridge ID number. The printer 100A also sets the field in the information database D3 for the next cartridge ID number to a null field.

Subsequently, the company operating the delivery server 400 collects the used ink cartridge 200, at which time the ID number for the collected ink cartridge 200 is recorded in the collection list on the delivery server 400. In S36 the delivery server 400 transmits the cartridge ID number for the collected ink cartridge 200 to the management server 300, and then the management server 300 receives the ID number for the cartridge 200 (S260).

On the system 1000 described above, the same cartridge management process is also executed by the printer 100B, the management server 300, and the delivery server 400. According to the system 1000 of the embodiment, an ink cartridge 200 is delivered to the user of the printer 100A at a suitable timing. By delivering an ink cartridge 200 at a suitable timing, the user of the printer 100A need not have an excess stock of ink cartridges 200, while the printer 100A is unlikely to run out of ink and become unable to print.

A-2-2. Processes Performed by the Printers 100A and 100B

As described above, the printers 100A and 100B in the embodiment both employ a double-chamber supply method. Therefore, the printers 100A and 100B can continue printing even after the ink cartridges 200 have been removed by using ink Ik remaining in the intermediate tanks 175, provided that there are no restrictions placed on printing executed by the printers 100A and 100B. For this reason, the ink cartridge 200 may be easily removed from the printers 100A and 100B. However, the printers 100A and 100B in the embodiment have been configured to prevent the ink cartridge 200 from being removed too easily, i.e., without some consideration. Next, a print management process A and a print management process B executed by the printer 100A to prevent the ink cartridge 200 from being easily removed will be described. A description of the processes executed by the printer 100B has been omitted since the processes are the same as those executed by the printer 100A.

Figure 8:
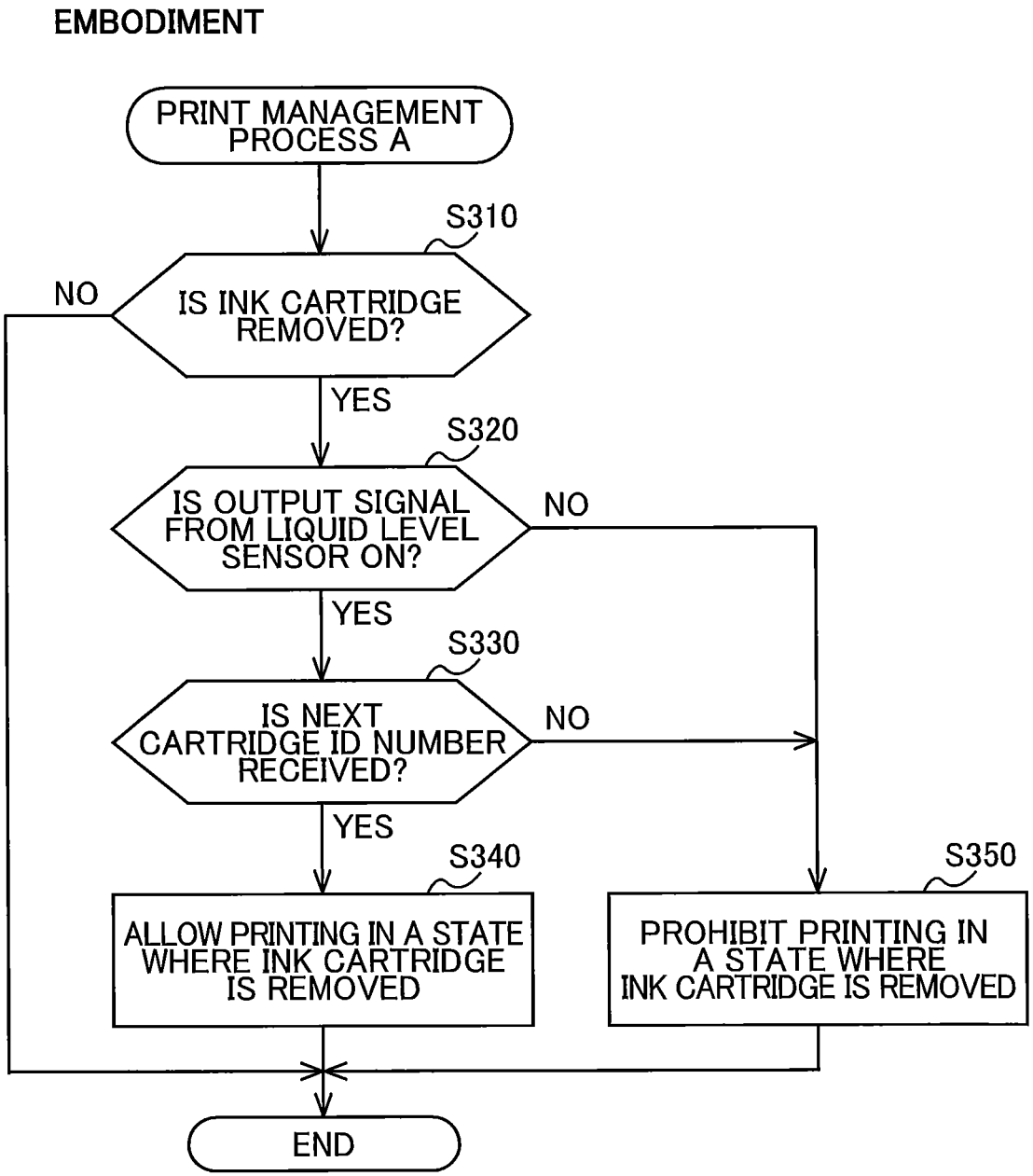
FIG. 8 is a flowchart illustrating a print management process performed by a printer according to the embodiment.

FIG. 8 is a flowchart illustrating steps in the print management process A. The printer 100A (the CPU 110) repeatedly executes the print management process A (every 0.1 seconds, for example) while the printer 100A is running, for example.

In S310 the CPU 110 of the printer 100A determines whether the ink cartridge 200 has been removed. The CPU 110 determines that the ink cartridge 200 was removed when detecting that the electric signal outputted by the mounting sensor AS has changed from the mounted signal to the unmounted signal. The CPU 110 advances to S320 when determining that the ink cartridge 200 was removed (S310: YES). If the CPU 110 determines that the ink cartridge 200 was not removed (S310: NO), the CPU 110 ends the print management process A. Accordingly, the process from S320 is executed each time the ink cartridge 200 is removed.

In S320 the CPU 110 determines whether the output signal from the liquid level sensor SS is the ON signal. An ON signal outputted from the liquid level sensor SS signifies that the storage state of ink Ik is the second storage state S2, as described above, and specifically that the residual quantity of ink Ik has dropped below the boundary volume BV. A residual quantity of ink Ik below the boundary volume BV signifies that ink Ik no longer remains in the ink cartridge 200 removed from the printer 100A, i.e., that the residual quantity of ink Ik in the ink cartridge 200 is 0.

If the output signal from the liquid level sensor SS is the ON signal (S320: YES), in S330 the CPU 110 determines whether a next cartridge ID number has been received. Specifically, the printer 100A determines that a next cartridge ID number was received when an ID number is stored in the field of the information database IB for the next cartridge ID number, and determines that a next cartridge ID number was not received when the field is a null field.

If a next cartridge ID number was received (S330: YES), in S340 the CPU 110 allows printing in a state where the ink cartridge 200 is removed and subsequently ends the print management process A. Specifically, the CPU 110 sets a first printing control flag to ON.

However, if the output signal from the liquid level sensor SS is the OFF signal (S320: NO) or if a next cartridge ID number was not received (S330: NO), in S350 the CPU 110 prohibits printing in a state where the ink cartridge 200 is removed and subsequently ends the print management process A. Specifically, the CPU 110 sets the first printing control flag to OFF.

In the state where the first printing control flag is set to OFF, the CPU 110 displays an error message on the display 140 and does not execute printing operations according to any print commands acquired in the state where the ink cartridge 200 is removed. The error message prompts the user to mount an ink cartridge 200, for example. On the other hand, in the state where the first printing control flag is set to ON, the CPU 110 controls the print execution device 160 to execute a printing operation in accordance with any print command acquired in the state where the ink cartridge 200 is removed.

Figure 9:
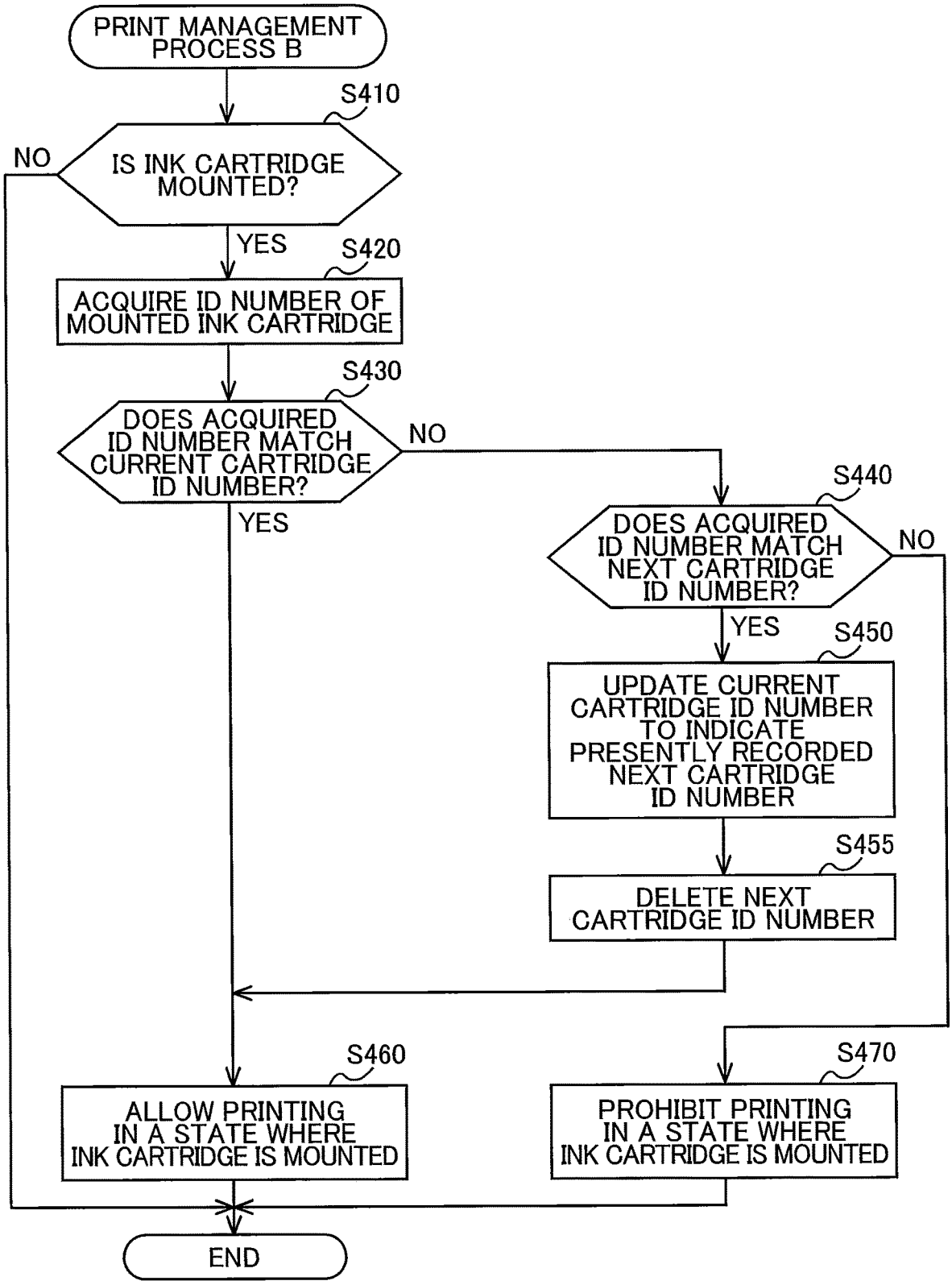
FIG. 9 is a flowchart illustrating a print management process performed by the printer according to the embodiment.

Next, the print management process B will be described with reference to the flowchart in FIG. 9. As with the print management process A, the printer 100A (the CPU 110) repeatedly executes the print management process B (every 0.1 seconds, for example) while the printer 100A is running, for example.

In S410 the CPU 110 of the printer 100A determines whether an ink cartridge 200 was mounted. The CPU 110 determines that an ink cartridge 200 was mounted when detecting that the electric signal outputted from the mounting sensor AS changed from the unmounted signal to the mounted signal. The CPU 110 advances to S420 when determining that an ink cartridge 200 was mounted (S410: YES), and ends the print management process B when determining that an ink cartridge 200 was not mounted (S410: NO). In this way, the process beginning from S420 is executed each time an ink cartridge 200 is mounted.

In S420 the CPU 110 acquires the ID number of the mounted ink cartridge 200 from the chip 250 on the ink cartridge 200. In S430 the CPU 110 determines whether the ID number for the mounted ink cartridge 200 matches the current cartridge ID number recorded in the information database D3. If the ID number of the mounted ink cartridge 200 matches the current cartridge ID number (S430: YES), the CPU 110 determines that the ink cartridge 200 was remounted and advances to S460.

If the CPU 110 determines that the ID number of the mounted ink cartridge 200 does not match the current cartridge ID number (S430: NO), in S440 the CPU 110 determines whether the ID number of the mounted ink cartridge 200 matches the next cartridge ID number recorded in the information database IB.

If the ID number for the mounted ink cartridge 200 matches the next cartridge ID number (S440: YES), the CPU 110 can determine that the ink cartridge 200 was replaced. In other words, the CPU 110 detects the replacement of the ink cartridge 200 in this case (equivalent to S32 of FIG. 7). Therefore, in S450 the CPU 110 sets the field of the current cartridge ID number to the number which is presently recorded in the field of the next cartridge ID number. That is, the CPU 110 copies the number in the field of the next cartridge ID number to the field (or the memory area) of the information database D3 used to specify the current cartridge ID number. In S455 the CPU 110 deletes the next cartridge ID number recorded in the information database D3 and advances to S460. Here, the CPU 110 sets the field in the information database D3 for the next cartridge ID number to a null field. Steps S450 and S455 are equivalent to updating the current ID number in S34 of FIG. 7.

If the ID number for the mounted ink cartridge 200 does not match the next cartridge ID number (S440: NO) in S470 the CPU 110 prohibits printing in a state where the ink cartridge 200 is mounted and subsequently ends the print management process B. Specifically, the CPU 110 sets a second printing control flag to OFF.

In S460 the CPU 110 allows printing in a state where the ink cartridge 200 is mounted and subsequently ends the print management process B. Specifically, the CPU 110 sets the second printing control flag to ON.

In the state where the second printing control flag is set to OFF, the CPU 110 displays an error message on the display 140 and does not execute any printing operations in accordance with print commands acquired in the state where the ink cartridge 200 is mounted. The error message indicates that the currently mounted ink cartridge is not a suitable cartridge, for example. On the other hand, in the state where the second printing control flag is set to ON, the CPU 110 controls the print execution device 160 to execute printing operations in accordance with print commands acquired in the state where the ink cartridge 200 is mounted.

Here, an ink cartridge 200 having the current cartridge ID number recorded in the information database IB will be called a first cartridge and an ink cartridge 200 having the next cartridge ID number recorded in the information database IB will be called a second cartridge. The second cartridge is the ink cartridge to be used following the first cartridge. According to the embodiment described above, the CPU 110 allows the print execution device 160 to execute printing operations in the state where the first cartridge is removed from the mount portion 172 (S340 of FIG. 8) if the residual quantity of ink Ik in the first cartridge is less than a reference (0 in the embodiment) as determined from the output signal of the liquid level sensor SS (S320: YES in FIG. 8) and the ID number for the second cartridge (the next cartridge ID number) has been acquired (S330: YES in FIG. 8). The CPU 110 prohibits the print execution device 160 from executing printing operations in the state where the first cartridge is removed from the mount portion 172 if the residual quantity of ink Ik in the first cartridge is greater than or equal to the reference as determined based on the output signal from the liquid level sensor SS (S320: NO in FIG. 8) or if the ID number for the second cartridge has not been acquired (S330: NO in FIG. 8).

Here, the need to replace the first cartridge with the second cartridge is high when the residual quantity of ink Ik in the first cartridge is less than the reference. If the ID number for the second cartridge has been acquired, there is a high probability that the second cartridge is available and that the first cartridge can be replaced with the second cartridge. In the embodiment, the printer allows printing in the state where the first cartridge is removed from the mount portion 172 if the need to replace the first cartridge with the second cartridge is high and the probability that the first cartridge can be replaced with the second cartridge is high, thereby suppressing the first cartridge from being removed from the printer 100A without careful consideration. Thus, this method can suppress problems arising when the first cartridge is carelessly removed despite the need for and possibility of replacing the cartridge being low, for example.

If printing were allowed in a state where the first cartridge is removed despite the first cartridge containing ink Ik greater than or equal to the reference (greater than or equal to 0 in the embodiment), there is a great possibility of the first cartridge being removed at this time and being left out. If the first cartridge is removed at this time, problems such as the first cartridge being lost or accidentally discarded may occur despite the residual ink Ik in the first cartridge being greater than or equal to the reference. In such a case, the unused ink Ik will be wasted. In addition, if printing were allowed in the state where the first cartridge is removed at this time, the printer would be unable to continue printing after all ink Ik remaining in the intermediate tank 175 is consumed, despite there being residual ink Ik in the first cartridge. However, the embodiment described above can suppress such problems from occurring.

Further, if printing were allowed in the state where the first cartridge is removed while a cartridge ID number for a second cartridge has not yet been acquired, despite the residual ink Ik in the first cartridge being less than the reference (0 in the embodiment), the first cartridge will likely remain removed at this time. If the first cartridge is removed at this time, the first cartridge cannot be replaced by a second cartridge because a second cartridge has not yet been prepared, and the first cartridge will simply remain removed. In such a case, the first cartridge may be lost before being replaced by a second cartridge, preventing the first cartridge from being collected. The embodiment described above can suppress the occurrence of such problems.

If the residual ink Ik in the first cartridge is less than the reference and a cartridge ID number has been acquired for the second cartridge, printing is allowed in the state where the first cartridge is removed. Hence, printing can be executed at this time using residual ink Ik in the intermediate tank 175, even when the first cartridge is removed. Thus, if the first cartridge is removed an appropriate period of time before the second cartridge arrives and is stored in a predetermined location, for example, the delivery manager will be able to collect the first cartridge easily without any printing restrictions being imposed on the printer 100A, thereby improving the recovery rate of first cartridges.

According to the embodiment described above, if an ink cartridge 200 is mounted in the printer but the ID number for the ink cartridge 200 does not match the current cartridge ID number or the next cartridge ID number recorded in the information database IB (S430: NO and S440: NO in FIG. 9), the printer 100A is restricted from printing (S470 of FIG. 9), despite an ink cartridge 200 being mounted in the printer 100A. This method can suppress an ink cartridge 200 from being mounted in a different printer than the intended printer 100A (a printer not requiring ink cartridge replacement, for example).

In the embodiment described above, an ID number identifying the second cartridge is used in the print management process A as information related to preparation of the second cartridge. If an ID number has been set for the second cartridge, it is likely that the second cartridge will be delivered and acquired within a suitable time period. Accordingly, the printer 100A can allow printing while the first cartridge is removed from the mount portion 172, in a case where the second cartridge can be obtained within the suitable time period. Hence, this method more effectively suppresses the first cartridge from being removed without careful consideration.

In the embodiment, the printer 100A, acquires an ID number for the second cartridge from the management server 300 via the communication interface 180 (S28 of FIG. 7). Thus, the printer 100A can easily acquire the ID number for the second cartridge while placing less burden on the user than if the user were required to input the ID number for the second cartridge.

The printer 100A transmits residual ink information specifying the residual quantity of ink Ik in the first cartridge to the management server 300 (S16 of FIG. 7). The printer 100A acquires the ID number for a second cartridge from the management server 300 (S28 of FIG. 7) at a timing set based on this residual ink information (the estimated order date OD in the embodiment). Thus, the printer 100A can acquire the ID number for the second cartridge at a suitable timing (a timing earlier than the expected cartridge replacement date BD by a prescribed number of days AD in the embodiment), thereby more effectively suppressing the first cartridge from being removed without careful consideration. If the ID number for the second cartridge were acquired too early, printing in the state where the first cartridge is removed could be allowed at too soon before the timing at which the first cartridge can be replaced by the second cartridge. In such a case, the user of the printer 100A might remove the first cartridge without careful consideration.

When the printer 100A detects that the first cartridge was replaced by the second cartridge in the embodiment described above (S440: YES in FIG. 9), the printer 100A sets the ID number for the second cartridge as the current cartridge ID number in place of the ID number for the first cartridge (S450) and sets the field for recording the next cartridge ID number to a null field (S455). Since the next cartridge ID number has not yet been received at this point, the printer 100A prevents printing in the state where the currently mounted second cartridge is removed in the print management process A of FIG. 8 (S330: NO, S350 in FIG. 8). That is, if the printer 100A detects that the second cartridge has been mounted in the mount portion while printing is being allowed in a state where the first cartridge is removed from the mount portion 172, i.e., when the first cartridge is replaced by the second cartridge, the printer 100A prevents printing in the state where the second cartridge is removed. Thus, the printer 100A can suppress the second cartridge from being removed too readily after the first cartridge was replaced by the second cartridge.

In the embodiment described above, if the first cartridge was removed from the mount portion 172 and subsequently remounted in the mount portion 172, in S430 of FIG. 9 the printer 100A detects that the ID number of the mounted first cartridge matches the current cartridge ID number recorded in the information database IB (S430: YES in FIG. 9). In this case, the printer 100A allows printing in the state where the first cartridge is mounted (S460 of FIG. 9). Thus, printing is allowed when the first cartridge is remounted despite printing being prohibited in the state where the first cartridge was removed from the mount portion 172, thereby suppressing printing from being excessively restricted.

As described in the print management process A of FIG. 8 according to the embodiment, printing is prohibited in the state where the first cartridge is removed until the condition that the residual quantity of ink Ik in the first cartridge is less than the reference (S320 of FIG. 8) and the condition that an ID number for the second cartridge is received (S330 of FIG.

8) are both satisfied. In other words, if the residual quantity of ink Ik in the first cartridge is greater than or equal to the reference when the second cartridge is acquired, the printer 100A prevents printing in the state where the first cartridge is removed until the residual quantity of ink Ik in the first cartridge is less than the reference, and allows printing in the state where the first cartridge is removed after the residual quantity of ink Ik in the first cartridge is below the reference. Thus, the first cartridge is suppressed from being easily removed until the residual quantity of ink Ik in the first cartridge drops below the reference, even if the second cartridge is available and it is likely that the first cartridge can be replaced with the second cartridge. Hence, this method suppresses the first cartridge from being removed while ink Ik remains in the first cartridge.

In the embodiment described above, the management server 300 sets the timing at which the ID number for the second cartridge is transmitted to the printer 100A (and specifically the estimated order date OD) based on the residual ink information received from the printer 100A (S140 of FIG. 4, FIG. 5). The management server 300 transmits the ID number for the second cartridge to the printer 100A at this timing (S210: YES, S250 in FIG. 6). Thus, since the ID number for the second cartridge is transmitted from the management server 300 to the printer 100A at a suitable timing, the first cartridge is more effectively suppressed from being removed without careful consideration.

In the embodiment, the management server 300 receives the ID number for the first cartridge when the first cartridge is collected from the user of the printer 100A (S260 of FIG. 6). Thus, the operator of the management server 300 can confirm whether collection of the first cartridge was successful.

In the above description, the output signal of the liquid level sensor SS is an example of the first information, and the information specifying the residual quantity of ink Ik in the first cartridge recorded in the information database IB is an example of the third information. The identification information for the second cartridge is an example of the second information. The process executed by the management server 300 for transmitting order information for a second cartridge to the delivery server 400 (S220 of FIG. 6) is an example of the preparatory process for preparing the second cartridge.

Figure 10:
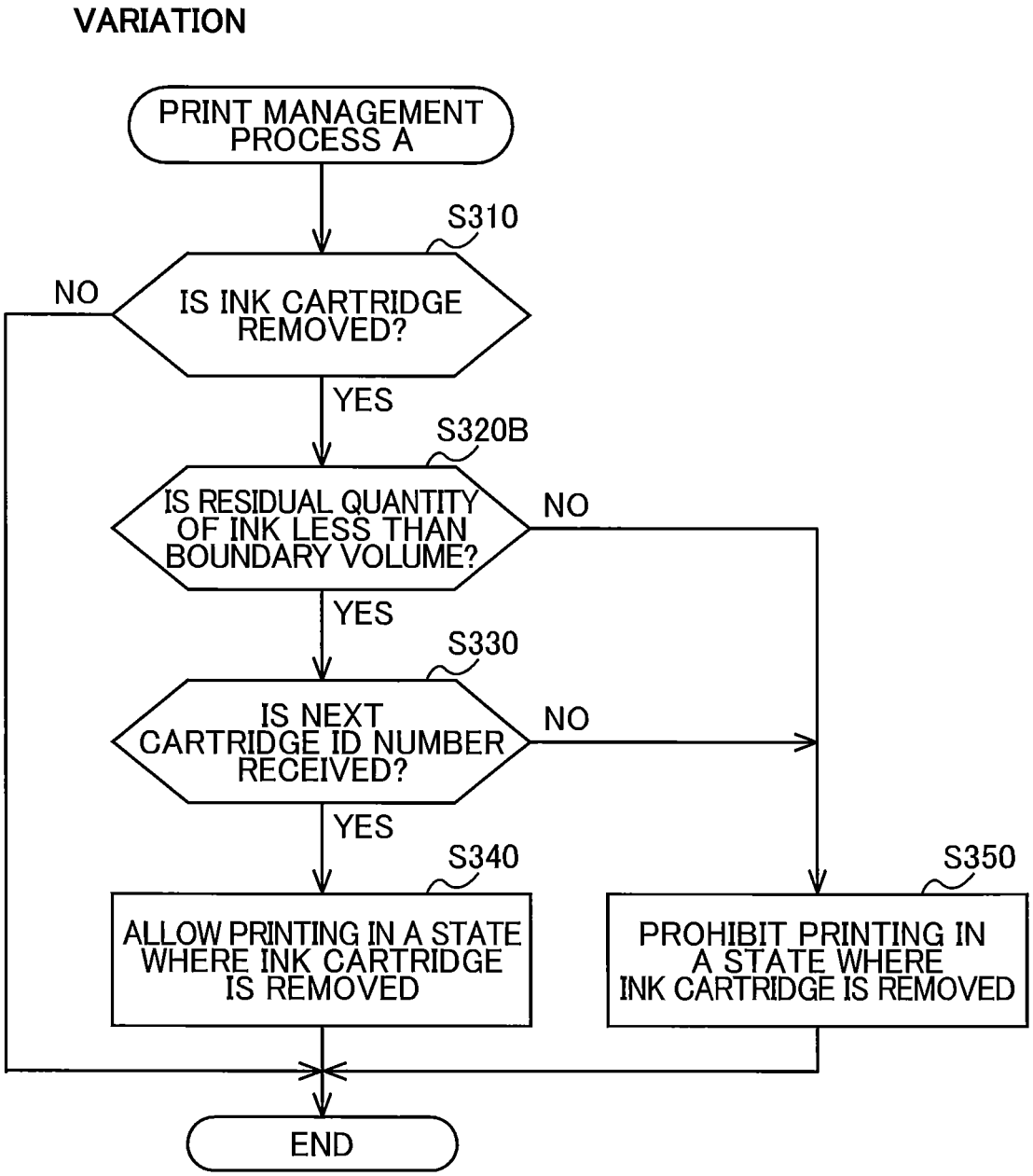
FIG. 10 is a flowchart illustrating a print management process performed by a printer according to a variation.

B. Variations of the Embodiment (1) FIG. 10 is a flowchart illustrating steps in a variation of the print management process A. The print management process A in FIG. 10 differs from that of the embodiment (see FIG. 8) in that step S320B is executed in place of step S320 of FIG. 8. The remainder of the process in FIG. 10 is identical to that in FIG. 8 and, hence, all other steps in FIG. 10 are assigned the same step numbers used in FIG. 8.

In S320B the CPU 110 of the printer 100A references the information database IB to determine whether the residual quantity of ink Ik recorded in the information database IB is less than the boundary volume BV. The CPU 110 advances to S330 when the residual quantity of ink Ik recorded in the information database IB is less than the boundary volume BV (S320B: YES) and advances to S350 when the residual quantity of ink Ik is greater than or equal to the boundary volume BV (S320B: NO).

In this way, the determination regarding whether the residual quantity of ink Ik is less than the boundary volume BV is not limited to a determination using the liquid level sensor SS. Further, the determination in S320 of the embodiment is based on the output signal of the liquid level sensor SS at the point in time that step S320 is executed, but the printer 100A may record the detected output signal from the liquid level sensor SS in the information database IB each time a printing operation is performed. Subsequently in S320 the CPU 110 may determine whether the residual quantity of ink Ik is less than the boundary volume BV based on the detected result recorded in the information database IB.

(2) In the embodiment described above, printing is allowed in the state where the first cartridge is removed as long as the condition that the residual quantity of ink Ik in the first cartridge is less than the reference (S320 of FIG. 8: YES) and the condition that an ID number for the second cartridge has been received (S330 of FIG. 8: YES) are both satisfied. As an alternative, the printer 100A may prohibit printing in the state where the first cartridge is removed if the residual quantity of ink Ik in the first cartridge is greater than or equal to the reference. In this alternative, the printer 100A may allow printing in the state where the first cartridge is removed if the residual quantity is less than the reference even if an ID number for the second cartridge has not been received. In this case, the printer 100A can suppress the first cartridge from being removed without careful consideration despite the first cartridge containing a quantity of residual ink Ik greater than or equal to the reference. Further, since printing is allowed in the state where the first cartridge is removed if the residual quantity of ink in the first cartridge is less than or equal to the reference, even if an ID number for the second cartridge has not been received, the printer 100A can execute a printing operation when the first cartridge is removed to be replaced with an ink cartridge other than the second cartridge, for example. In this case, in the print management process B the printer 100A may allow printing in a state where a cartridge is mounted even if the ID number for the mounted ink cartridge does not match the next cartridge ID number recorded in the information database IB (S440: NO in FIG. 9). In this case, the management server 300 may not transmit the ID number for the second cartridge to the printer 100A, the printer 100A need not record the ID number for the second cartridge in the information database IB, and the printer 100A may not perform the determination in S330 of FIG. 8.

(3) The printer 100A may prohibit printing in the state where the first cartridge is removed if an ID number for a second cartridge has not been received. The printer 100A may allow printing in the state where the first cartridge is removed if an ID number has been received for the second cartridge, even if the residual quantity of ink Ik in the first cartridge is greater than or equal to the reference. In this way, the printer 100A can suppress the first cartridge from being removed haphazardly despite an ID number not being received for a second cartridge (despite a second cartridge not being ordered in the embodiment). In this case, the printer 100A allows printing in the state where the first cartridge is removed, in a case where an ID number has been received for the second cartridge, even if the residual quantity of ink Ik in the first cartridge is greater than the reference. Thus, if the first cartridge is removed to be replaced when the second cartridge has arrived, for example, the printer 100A can execute a printing operation despite there being a certain amount of residual ink Ik in the first cartridge.

(4) In the embodiment described above, the ID number for the second cartridge is used as information related to the preparation of the second cartridge. However, the information related to preparation of the second cartridge may be information specifying that the second cartridge has been ordered and need not include an ID number for the second cartridge. Alternatively, information related to preparation of the second cartridge may be information specifying that the second cartridge has been delivered (or (to be) shipped) or may be information specifying the order date or delivery date for the second cartridge.

(5) In the embodiment described above, the printer 100A acquires an ID number for the second cartridge from the management server 300. As an alternative, the printer 100A may acquire (receive) the ID number for the second cartridge from the delivery server 400 without passing through the management server 300. The printer 100A may also acquire the ID number for the second cartridge via the operation interface 150. In this case, the ID number for the second cartridge may be transmitted to a terminal device of the user, for example, and the user may input this ID number for the second cartridge into the printer 100A via the operation interface 150.

(6) In the embodiment described above, the printer 100A transmits residual ink information specifying the residual quantity of ink Ik to the management server 300 (S16 and S18 of FIG. 7). Here, the information transmitted to the management server 300 may be other information related to the residual quantity of ink Ik, such as information specifying the residual rate (percentage) of ink Ik in the first cartridge or information specifying the number of sheets that can be printed using the residual ink Ik in the first cartridge. Alternatively, the information transmitted to the management server 300 may be information specifying the cumulative number of sheets that have been printed to date since the ink cartridge was last replaced or may be information specifying the quantity of ink Ik consumed to date since the ink cartridge was last replaced. Based on this information and a predetermined initial quantity of ink Ik in the first cartridge, the management server 300 can identify the residual quantity of ink Ik in the first cartridge. An average quantity of ink Ik per sheet may be used for identifying the residual quantity of ink Ik.

(7) In the embodiment described above, the printer 100A determines whether the residual quantity of ink Ik in the first cartridge is less than the reference based on the residual quantity of ink Ik recorded in the information database IB (S320 of FIG. 8). However, the printer 100A may determine whether the residual quantity of ink Ik in the first cartridge is less than the reference based on other information related to the residual quantity of ink Ik. Such other information includes any of the information listed in variation (6) described above. In this case, information to be used in place of the residual quantity of ink Ik may be recorded in the information database IB or the information to be used may be calculated based on the residual quantity of ink Ik recorded in the information database IB. Further, the information related to the residual quantity of ink Ik used for determining whether the residual quantity of ink Ik in the first cartridge is less than the reference may be of a different type than the information related to the residual quantity of ink Ik transmitted to the management server 300.

(8) In the embodiment described above, the management server 300 sets the estimated order date OD based on residual ink information received from the printer 100A. However, the management server 300 may instead set the estimated order date OD to a predetermined date (a predetermined day of the month) if the amount of consumed ink Ik on the printer 100A is stable. Specifically, the management server 300 sets a predetermined day of each month (fifth day for each month, for example) as a candidate day for the estimated order date. When the cartridge replacement date BD (see FIG. 5) is calculated, the management server 300 sets the estimated order date to a predetermined day of a specific month which is closest to the cartridge replacement date BD among candidate days before the cartridge replacement date BD. The predetermined day of the specific month may be latest one of the candidate days prior to the cartridge replacement day BD more than the prescribed number of days AD.

(9) In the embodiment described above, the printer 100A allows printing in the state where the first cartridge is mounted if printing was allowed in the state where the first cartridge was removed and the removed first cartridge was remounted in the mount portion 172. However, the printer 100A may prohibit printing in the state where the first cartridge is mounted if the first cartridge was previously removed and subsequently remounted in the mount portion 172. In this way, the printer 100A can more effectively suppress the first cartridge from being removed without careful consideration.

(10) To avoid a complex description, the printer 100A in the embodiment described above is provided with a monochromatic print execution device 160 employing a single ink color (black (K), for example). However, the printer 100A may be provided with a printing mechanism using multiple colors of ink Ik, such as a print execution device capable of printing color images using ink in the four colors cyan (C), magenta (M), yellow (Y), and black (K). In this case, four ink cartridges 200 corresponding to the four colors of ink can be mounted in the printer 100A. Here, the printer 100A may manage the residual quantities of ink Ik and cartridge ID numbers independently for each of the four ink cartridges 200 and may execute the print management processes A and B in FIGS. 8 and 9 independently for each of the four ink cartridges 200. Further, the management server 300 may manage the residual quantities of ink Ik, the cartridge ID numbers, and the estimated order dates OD independently for each of the four ink cartridges 200 and may execute the residual quantity management process of FIG. 4 and the order management process of FIG. 6 independently for each of the four ink cartridges 200.

(11) The printer 100A used as an example of the target printer in the embodiment is provided with an inkjet-type print execution device 160. However, the printer 100A may instead be provided with a printing mechanism employing an electrophotographic system (laser system, for example) for printing images using toner as the printing agent. In this case, the printer may be provided with a supply portion in which a toner cartridge is mountable, an intermediate tank (a subtank for temporarily storing toner, for example) that accommodates toner supplied from the toner cartridge mounted in the supply portion, and a print execution device that executes printing using toner accommodated in the intermediate tank. The processes described in the embodiment may be applied to this type of printer when the printer is provided with a double-chamber supply method for supplying toner.

(12) While the management server 300 and the delivery server 400 in the embodiment are separate devices, a single server may be used to perform the functions of both devices. In this case, the communications between the management server 300 and the delivery server 400 shown in FIG. 7 may be omitted.

(13) While the management server 300 is connected to the internet IT in the embodiment, the management server 300 may be connected to the local area network NT instead. In this case, the management server 300 may acquire residual ink information from the printers 100A and 100B by periodically requesting such information using the Simple Network Management Protocol (SNMP).

(14) The management server 300 and/or the delivery server 400 may be a cloud server, for example, that includes a plurality of computers capable of communicating with each other over a network.

(15) In the embodiment described above, part of the configuration implemented in hardware may be replaced with software and, conversely, all or part of the configuration implemented in software may be replaced with hardware.

(16) When all or some of the functions of the present disclosure are implemented with computer programs, the programs may be stored on a computer-readable storage medium (a non-temporary storage medium, for example). The programs may be used on the same storage medium on which they were supplied or may be transferred to a different storage medium (a computer-readable storage medium). The "computer-readable storage medium" may be a portable storage medium, such as a memory card or CD-ROM; an internal storage built into the computer, such as any of various ROM or the like; or an external storage, such as a hard disk drive, connected to the computer.

While the disclosure has been described in detail with reference to the above embodiments, it would be apparent to those skilled in the art that various changes and modifications may be made thereto.

What is claimed is:

1. A printer comprising:

a mount portion on which a first cartridge storing printing agent is mountable;

an accommodating portion configured to accommodate the printing agent supplied from the first cartridge;

a print execution device configured to perform printing with the printing agent supplied from the accommodating portion; and a processor configured to perform:

acquiring first information concerning a residual quantity of the printing agent remaining in the first cartridge;

acquiring second information concerning a preparation of a second cartridge to be replaced with the first cartridge on the mount portion;

if the residual quantity of the printing agent remaining in the first cartridge is below a reference quantity and if the second information is acquired, allowing the print execution device to perform printing under a cartridge removed state where the first cartridge is removed from the mount portion; and if the residual quantity of the printing agent remaining in the first cartridge is larger than or equal to the reference quantity or if the second information is not acquired, prohibiting the print execution device from printing under the cartridge removed state.

2. The printer according to claim 1, wherein the second information includes identification information for identifying the second cartridge.

3. The printer according to claim 1, further comprising a communication interface configured to communicate with an external apparatus, wherein the processor acquires the second information from the external apparatus via the communication interface.

4. The printer according to claim 3, wherein the processor is configured to further perform transmitting to the external apparatus third information concerning the residual quantity of the printing agent remaining in the first cartridge, wherein the processor acquires the second information from the external apparatus at a timing which is determined by using the third information.

5. The printer according to claim 1, further comprising a detector configured to detect whether the second cartridge is mounted on the mount portion, wherein the processor is configured to further perform, in a case where the detector detects the second cartridge mounted on the mount portion after under the cartridge removed state the processor allows the print execution device to perform printing, prohibiting the print execution device from printing under a state where the second cartridge is removed from the mount portion.

6. The printer according to claim 1, wherein the processor is configured to further perform, in a case where the first cartridge is mounted again on the mount portion after under the cartridge removed state the processor prohibits the print execution device from printing, allowing the print execution device to perform printing under a state where the first cartridge is mounted on the mount portion.

7. The printer according to claim 1, wherein the processor is configured to further perform, once the first information indicates that the residual quantity of the printing agent remaining in the first cartridge is larger than or equal to the reference quantity:

prohibiting the print execution device from printing under the cartridge removed state until the processor acquires updated first information indicating that the residual quantity of the printing agent stored in the accommodating portion is lower than the reference quantity; and allowing the print execution device to perform printing under the cartridge removed state, in a case where the processor acquires the updated first information.

8. The printer according to claim 1, further comprising a sensor configured to output signal indicative of the residual quantity of the printing agent remaining in the first cartridge, wherein the processor acquires the output signal as the first information.

9. The printer according to claim 1, further comprising a detector configured to detect whether the second cartridge is mounted on the mount portion, wherein the processor is configured to further perform, in a case where the detector detects the second cartridge mounted on the mount portion after under the cartridge removed state the processor allows the print execution device to perform printing and where the processor does not acquires third information concerning a preparation for a third cartridge which is different from the first cartridge and the second cartridge and to be mounted on the mount portion, prohibiting the print execution device from printing under a state where the second cartridge is removed from the mount portion.

10. A system comprising a printer and an apparatus communicable with the printer, wherein the printer comprises:

a mount portion on which a first cartridge storing printing agent is mountable;

an accommodating portion configured to accommodate the printing agent supplied from the first cartridge;

a print execution device configured to perform printing with the printing agent supplied from the accommodating portion; and a first processor configured to perform:

acquiring first information concerning a residual quantity of the printing agent remaining in the first cartridge;

acquiring second information concerning a preparation of a second cartridge to be replaced with the first cartridge on the mount portion;

if the residual quantity of the printing agent remaining in the first cartridge is below a reference quantity and if the second information is acquired, allowing the print execution device to perform printing under a cartridge removed state where the first cartridge is removed from the mount portion; and if the residual quantity of the printing agent remaining in the first cartridge is larger than or equal to the reference quantity or if the second information is not acquired, prohibiting the print execution device from printing under the cartridge removed state, wherein the apparatus comprises a second processor configured to perform:

a preparation process for preparing the second cartridge; and transmitting the second information to the printer in a case where the preparation process is performed.

11. The system according to claim 10, wherein the first processor is configured to further perform transmitting third information concerning the residual quantity of the printing agent accommodated in the first cartridge to the apparatus, wherein the second processor is configured to further perform determining timing at which the second information is transmitted on a basis of the third information, wherein the second processor transmits the second information to the printer at the determined timing.

12. The system according to claim 10, wherein the second processor is configured to perform receiving identification information for identifying the first cartridge in a case where the first cartridge with the printing agent below the reference quantity is collected from a user of the printer.

13. A non-transitory computer readable storage medium storing a set of program instructions for a printer having: a mount portion on which a first cartridge storing printing agent is mountable; an accommodating portion configured to accommodate the printing agent supplied from the first cartridge; a print execution device configured to perform printing with the printing agent supplied from the accommodating portion; and a processor, the set of program instructions comprising:

acquiring first information concerning a residual quantity of the printing agent remaining in the first cartridge;

acquiring second information concerning a preparation of a second cartridge to be replaced with the first cartridge on the mount portion;

if the residual quantity of the printing agent remaining in the first cartridge is below a reference quantity and if the second information is acquired, allowing the print execution device to perform printing under a cartridge removed state where the first cartridge is removed from the mount portion; and if the residual quantity of the printing agent remaining in the first cartridge is larger than or equal to the reference quantity or if the second information is not acquired, prohibiting the print execution device from printing under the cartridge removed state.

* * * * *